US006009638A

United States Patent [19]

Maravetz et al.

[11] Patent Number: 6,009,638

[45] Date of Patent: Jan. 4, 2000

[54] MOUNTING FOR A SNOWBOARD BOOT STRAP

[75] Inventors: Paul T. Maravetz, Stowe; Peter M. Curran, Jericho; Joshua S. Reid, Stowe; David J. Dodge, Williston; Frank Phillips, Richmond, all of Vt.

[73] Assignee: The Burton Corporation, Burlington, Vt.

[21] Appl. No.: 09/003,234

[22] Filed: Jan. 6, 1998

[51] Int. Cl.[7] ..... A43B 5/04; A43B 1/00; A43B 23/02

[52] U.S. Cl. ..... 36/115; 36/117.1; 36/117.9

[58] Field of Search ..... 36/50.1, 50.5, 36/88, 92, 115, 116, 117.1, 117.9, 118.1; 24/71 SK, 70 SK, 70 ST, 69 SK

[56] References Cited

U.S. PATENT DOCUMENTS

| | | | |
|---|---|---|---|
| 2,096,677 | 10/1937 | Fassett . | |
| 2,444,428 | 7/1948 | Carrier . | |
| 3,535,800 | 10/1970 | Stöhr . | |
| 3,813,796 | 6/1974 | Olivieri . | |
| 4,051,611 | 10/1977 | Chalmers | 36/50.5 |
| 4,126,323 | 11/1978 | Scherz . | |
| 4,160,332 | 7/1979 | Salomon | 36/119 |
| 4,268,981 | 5/1981 | Olivieri . | |
| 4,326,320 | 4/1982 | Riedel | 24/70 SK |
| 4,387,517 | 6/1983 | Annovi | 36/117.1 |
| 4,395,801 | 8/1983 | Gabrielli | 24/70 SK |
| 4,547,980 | 10/1985 | Olivieri | 36/50.5 |
| 4,649,657 | 3/1987 | Iwama | 36/117.1 |
| 4,670,946 | 6/1987 | Olivieri | 24/71 SK |
| 4,683,620 | 8/1987 | Valsecchi et al. | 24/71 SK |
| 4,727,627 | 3/1988 | Baggio et al. | 36/50.5 |
| 4,761,898 | 8/1988 | Courvoiser et al. | 36/117.1 |
| 4,796,337 | 1/1989 | Marxer | 24/68 SK |
| 5,172,454 | 12/1992 | Martignago | 24/68 SK |
| 5,416,952 | 5/1995 | Dodge | 24/68 SK |
| 5,495,683 | 3/1996 | Miotto et al. . | |
| 5,498,033 | 3/1996 | Hoshizaki et al. . | |
| 5,530,997 | 7/1996 | Tessari | 24/70 SK |
| 5,611,155 | 3/1997 | Brown et al. . | |
| 5,678,833 | 10/1997 | Olson et al. . | |
| 5,745,959 | 5/1998 | Dodge | 24/70 SK |
| 5,779,259 | 7/1998 | Lin | 24/70 SK |
| 5,802,741 | 9/1998 | Turner et al. | 36/115 |

FOREIGN PATENT DOCUMENTS

| | | | |
|---|---|---|---|
| 304404 | 2/1989 | European Pat. Off. | 36/50.5 |
| 0 852 958 | 7/1998 | European Pat. Off. | A63C 9/08 |
| 2476455 | 8/1991 | France | 36/50.5 |
| WO 97 27773 | 8/1997 | WIPO | A43B 5/04 |
| WO 97 34508 | 9/1997 | WIPO | A43B 5/04 |

OTHER PUBLICATIONS

K2 Snowboards 1997/1998 Product Catalog, 1997, pp. 33 and 34, and accompanying digital photographs of the boot shown therein.

*Primary Examiner*—Paul T. Sewell
*Assistant Examiner*—Anthony Stashick
*Attorney, Agent, or Firm*—Wolf, Greenfield & Sacks, P.C.

[57] ABSTRACT

A snowboard boot for use with a snowboard boot strap that is attachable thereto. In one aspect, the boot comprises a foot-shaped outer surface; and a strap mounting member that includes an attachment feature adapted to mount a portion of the strap to the snowboard boot, the strap mounting member including a raised portion that protrudes beyond the foot-shaped outer surface of the boot, the raised portion including the attachment feature. In another aspect, the snowboard boot includes a boot upper having an outer surface, a sole, and an adjustable strap that is mounted to the outer surface of the boot upper, the strap being adjustable so that the strap can be selectively tightened and loosened over the outer surface of the boot upper. The outer surface of the boot upper is formed from at least first and second materials, the first material having a lower coefficient of friction than the second material, the first material being disposed to underlie a portion of the strap that is movable to tighten the strap.

14 Claims, 5 Drawing Sheets

MOUNTING FOR A SNOWBOARD BOOT STRAP

DESCRIPTION

1. Technical Field

The present invention relates to a snowboard boot including a strap mounting member for attaching an adjustable strap to the snowboard boot.

2. Discussion of Related Art

In the sport of snowboarding, bindings are utilized to secure a rider's boot, and hence foot, to a snowboard. Generally, three types of bindings have been employed. A first type of binding is adapted to be used with a hard shell boot that is similar to an alpine ski boot. Typically, hard-shell boots include a hard plastic molded shell that is mounted to the snowboard by a plate binding that includes adjustable rear and forward bails to engage the heel and toe portions of the boot, respectively. A second type of binding is adapted for use with a soft boot which, as the name suggests, is at least partially made of a softer, less rigid material than hard snowboard boots. Soft boots are generally favored by snowboard riders who "freeride" or perform "freestyle" (trick-oriented) snowboarding. Conventional soft boot bindings include a rigid high back piece into which the heel of the boot is placed, and one or more straps that secure the boot to the binding.

A third type of binding is a step-in binding for soft snowboard boots. Step-in bindings eliminate the need for straps attached to the binding and, instead, provide the convenience of a strapless system to secure the soft snowboard boot to the binding. Step-in systems typically include a soft boot having an interface disposed along the lower portion of the boot to engage the step-in binding. An example of such a binding system is disclosed in currently pending U.S. patent application Ser. No. 08/584,053, entitled METHOD AND APPARATUS FOR INTERFACING A SNOWBOARD BOOT TO A BINDING, filed Jan. 8,1996 and commonly assigned to Burton Snowboards. To prevent a rider's foot, particularly the heel, from lifting within the boot in a step-in system, an ankle strap can be attached to the boot, at medial and lateral attachment points on the boot, to hold the rider's foot down in the bottom of the boot. An example of such a strap is disclosed in currently pending U.S. patent application Ser. No. 08/619,358, entitled A SNOWBOARD BOOT AND BINDING STRAP, filed Mar. 21, 1996, incorporated herein by reference and also commonly assigned to Burton Snowboards.

Conventionally, ankle straps have been attached directly to the surface of the boot and have employed a ratcheting mechanism to tighten a first strap component on the medial side of the boot with a second strap component on the lateral side of the boot. The ratcheting mechanism typically includes a ratcheting buckle mounted to one strap component, and a toothed strap component adapted to engage therewith. When the straps are directly attached to the outer surface of the boot, one of the strap components may become wedged between the other and the outer surface of the boot when the strap is tightened, thereby creating uncomfortable pressure points on the rider's foot. This wedging action also makes tightening the strap more difficult because of the friction created between the lower strap component and the outer surface of the boot.

Accordingly, it is an object of the present invention to provide a boot having a mounting member that acts as an interface for attachment of a strap to the boot so that the strap can be readily tightened without creating uncomfortable pressure points.

SUMMARY

One illustrative embodiment of the invention is directed to a snowboard boot for use with a snowboard boot strap that is attachable thereto. The boot comprises a foot-shaped outer surface; and a strap mounting member that includes an attachment feature adapted to mount a portion of the strap to the snowboard boot, the strap mounting member including a base that is supported at the outer surface of the snowboard boot and a raised portion that protrudes from the base beyond the foot-shaped outer surface of the boot, the raised portion including the attachment feature.

Another illustrative embodiment of the invention is directed to a snowboard boot, comprising a boot upper having an outer surface; a sole; and an adjustable strap that is mounted to the outer surface of the boot upper, the strap being adjustable so that the strap can be selectively tightened and loosened over the outer surface of the boot upper. The outer surface of the boot upper is formed from at least first and second materials, the first material having a lower coefficient of friction than the second material, the first material being disposed to underlie a portion of the strap that is movable to tighten the strap.

A further illustrative embodiment of the invention is directed to a snowboard boot for use with an adjustable snowboard boot strap that is attachable thereto, the strap being adjustable so that the strap can be selectively tightened and loosened over the boot. The boot comprises a boot upper having an outer surface; a sole; and a strap mounting member that is mounted to the outer surface of the boot upper and includes an attachment feature adapted to mount a portion of the strap to the snowboard boot. The outer surface of the boot upper is formed from at least first and second materials, the first material having a lower coefficient of friction than the second material, the first material being disposed adjacent the strap mounting member and being adapted to underlie a portion of the strap that is movable to tighten the strap.

A further illustrative embodiment of the invention is directed to a method of attaching a strap to a snowboard boot, the strap including first and second strap components, the snowboard boot including a medial side, a lateral side and a foot-shaped outer surface. The method comprises steps of: (A) attaching a first end of the first strap component to a first mounting member disposed on one of the medial and lateral sides of the boot such that the first end of the first strap component is spaced from the foot-shaped outer surface of the boot; and (B) attaching the second strap component the other of the medial and lateral sides of the boot.

BRIEF DESCRIPTION OF THE DRAWINGS

A number of illustrative embodiments of the invention are described herein with reference to the drawings, wherein.

DETAILED DESCRIPTION OF ILLUSTRATIVE EMBODIMENTS

Figure 1:
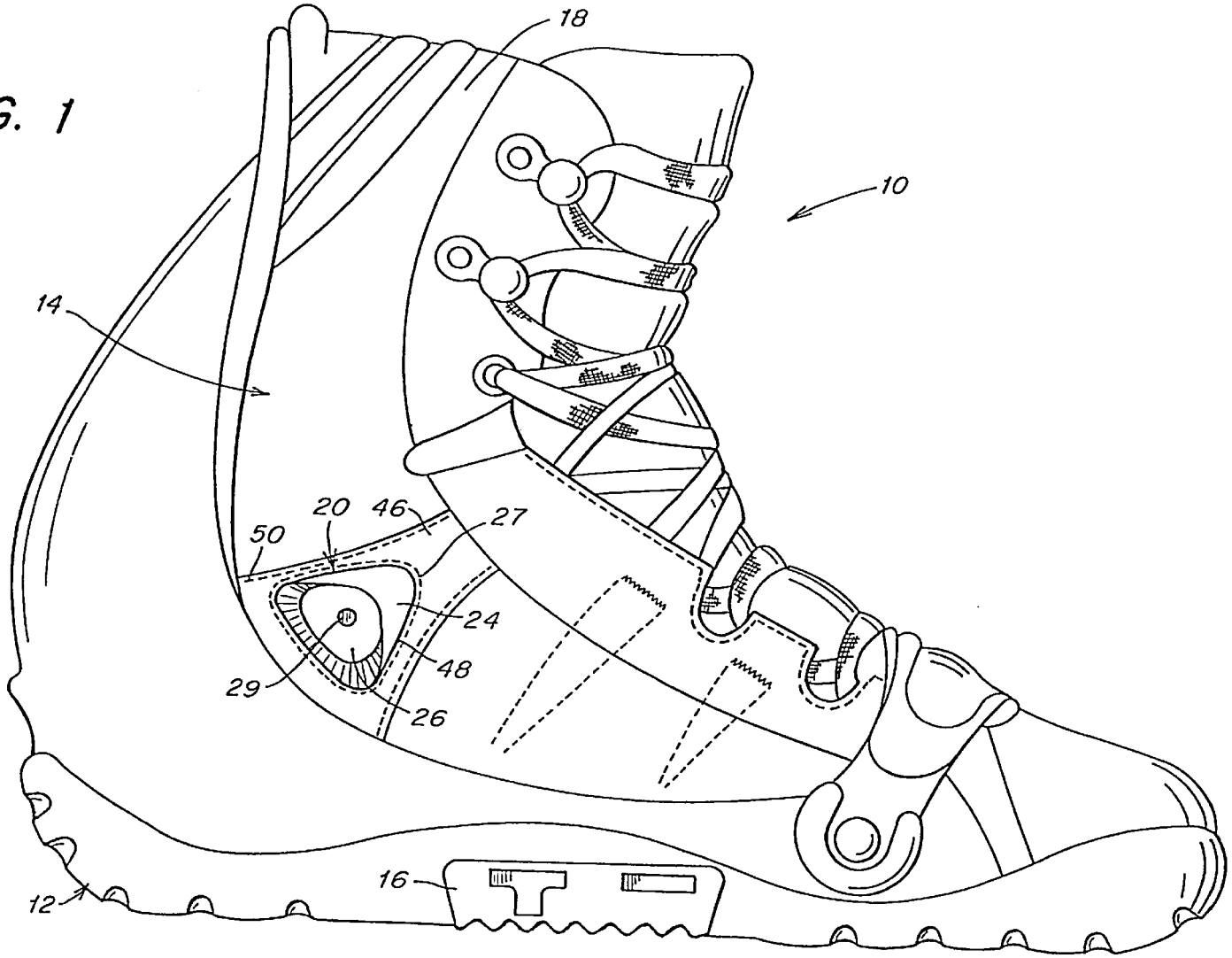
FIG. 1 is a medial side view of a boot including a raised mounting member for attaching a snowboard boot strap in accordance with one illustrative embodiment of the invention.

One illustrative embodiment of the invention, illustrated in FIGS. 1–5, is directed to a raised mounting member 20 for mounting a strap to a snowboard boot. As discussed in more detail below, a similar mounting member can be used on both sides of the boot to raise the attachment surfaces for a strap (e.g., 22 in FIG. 2) to the boot, thereby creating a space between the ends of the strap and the outer surface of the boot. In the embodiment shown in the drawings, the raised mounting member is for attaching an ankle strap that is adapted to hold the rider's heel in the boot. However, it should be appreciated that the present invention is not limited in this respect, and can be employed with any type of strap mounted to the boot.

In one illustrative embodiment of the present invention, the space created between the strap components and the surface of the boot allows the strap components to slide freely relative to one another, thereby reducing the pressure on the rider's foot as the strap is tightened.

FIGS. 1–5 illustrate a snowboard boot 10 that includes a mounting member 20 in accordance with one illustrative embodiment of the invention. It should be appreciated that the present invention is not limited to use with a boot of this or any other particular structure, and can be employed with snowboard boots of any type.

The boot 10 shown in FIGS. 1–5 is a soft snowboard boot designed for use with a step-in or strap-less binding system. The boot 10 includes a sole 12 and an upper portion 14. The raised mounting member 20 is adapted to attach a first portion 21 (FIG. 2) of an ankle strap 22 (FIG. 2) to the snowboard boot 10. The upper portion 14 of the boot 10 includes an inner surface (not shown) for engaging the foot and/or lower leg of a rider, and an outer surface 18. The upper portion 14 can be formed from a soft material (e.g. leather or synthetic material) and is laced up the front in a conventional manner. The outer sole 12 of the boot 10 can be formed of rubber to provide good traction, and includes a binding interface 16 at its medial (or inner) and lateral (or outer) sides (only the medial side is shown in FIG. 1) to engage with a strapless step-in binding. The particular binding interface shown in the drawings is disclosed in pending U.S. patent application Ser. No. 08/584,053 and is adapted to engage with a number of different step-in bindings. However, as mentioned above, the present invention is not limited to a boot having this construction, and can be provided on boots having any type of interface for engaging with a binding.

The mounting member 20 shown in FIG. 1 is secured to the medial side of boot 10. In one embodiment of the invention, a similar mounting member is also attached to the lateral side of the boot (see FIG. 4 wherein the mounting member attaches a strap portion 23 to the boot), such that a pair of mounting members is provided for the boot. Alternatively, in another embodiment of the invention, a single mounting member 20 is provided for the boot, on either the medial or lateral side. When only a single mounting member is provided, it is preferably provided on the side of the boot over which the first and second strap portions 21, 23 mate when the strap is tightened.

Mounting member 20 includes a base 24 that is attached to boot 10 (e.g., to the upper portion 14), and a raised top portion 26 that extends from the base away from the surface of the boot. The base 24 and top portion 26 together form a raised body or pedastal of the mounting member 20 that protrudes above the outer surface 18 of the boot 10. In the embodiment of FIG. 1, the base and top portion are molded together as a single unitary member. However, it should be understood that the base and top portion may be constructed of separate components, for example a plurality of washers, that can together form the raised mounting member 20.

Mounting member 20 can be fixed (i.e., non-removably attached) to the boot 10. For example, in the embodiment shown in FIG. 1, stitching 27 is provided around the perimeter of base 24 to secure the base to the upper portion 14 of the boot. It should be understood that other methods (e.g., adhesive) of non-removably attaching the mounting member can alternatively be employed. As used herein, the phrase "non-removably attached" is intended to indicate that the mounting member cannot readily be removed and reattached by the rider without damaging the boot 10. In another embodiment of the invention, mounting member 20 is removably attached to the boot so that the rider can remove and reattach the mounting 20 to the same location (e.g., on upper portion 14) of the boot. This removability can be advantageous, for example, when replacing a worn or broken mounting member, or when the boot strap is removed so that the boot can be utilized with a strap binding as discussed below. The mounting member 20 can be removably attached to boot 10 in a variety of ways. For example, the mounting member 20 can be formed as part of strap 22 and snap-fit into a recess formed in boot 10, or can be formed by stacking a plurality of washers that can be individually removed from a central mounting point on the boot.

As discussed above, strap 22 is employed when the boot is used with a strapless binding system to keep the rider's heel from lifting in the boot. In one embodiment of the invention, strap 22 is removably attached to the boot so the strap can be removed by the rider, for example to replace the strap with a different style strap or to replace a worn or broken strap, or to enable the boot to be used with a strap binding. The strap can be removably attached to the boot by removably attaching the mounting member 20 to the boot as described above, and/or making the strap 22 removably attachable to the mounting member 20 as described below. Although the removability of the strap 22 provides the advantages described above, it should be appreciated that the present invention is not limited in this respect, and that the strap 22 may be fixedly (i.e., non-removably) attached to the boot 10.

Figure 2:
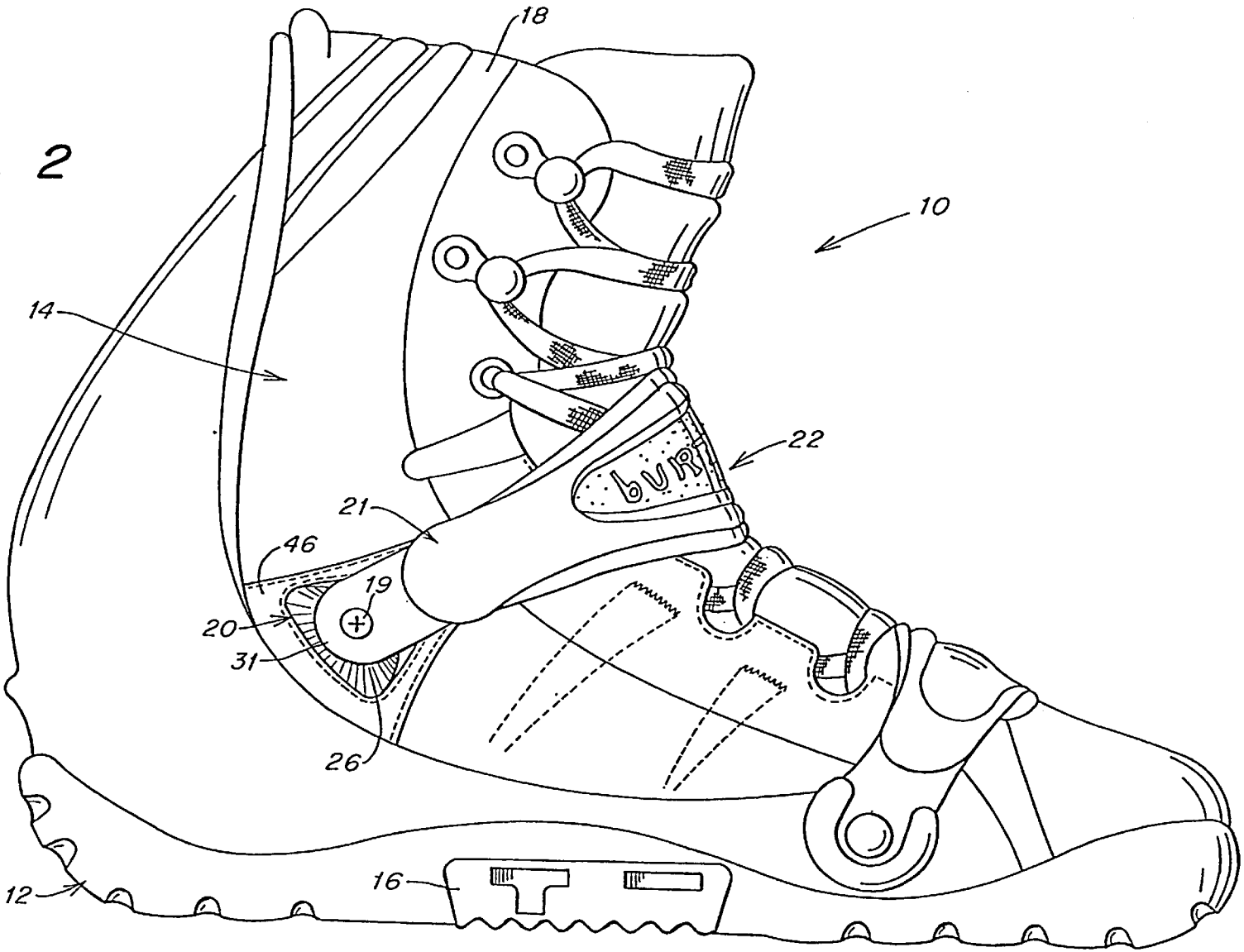
FIG. 2 is a medial side view of the boot shown in FIG. 1, including a strap attached thereto.

In the embodiment of the invention shown in FIG. 2, the ankle strap 22 includes a first portion 21 that is attached at one end 31 to the mounting member on the medial side of boot 10. The first strap portion 21 extends over and engages the instep portion of boot 10. In the embodiment shown, the first strap portion 21 is attached to the mounting member 20 at attachment point 29 (FIG. 1) by a threaded T-nut that is at least partially disposed in the mounting member 20, and a screw 19 that mates with the T-nut. The first strap portion 21 includes an opening through which the screw 19 is passed prior to tightening the screw into the T-nut to secure the strap portion 21 to the boot. The strap can be removed simply by loosening and removing the screw. Thus, the screw 19 and T-nut enable the strap portion 21 to be removably attached to the boot, such that the rider can repeatedly remove and reattach the strap at the location 29 (FIG. 1) without damaging the boot. The screw 19 can optionally have a flat head and a slot size that enables a small coin to be used to tighten/loosen the screw so that a screwdriver is unnecessary. It should be appreciated that the present invention is not limited to the use of a screw and T-nut to attach the strap portion 21 to the mounting member 20 as numerous other attachment techniques can be employed, such as a key-type fastener, snap fastener, a slot and hook fastener, etc.

The strap 22 also includes a second portion 23 (FIG. 4) that is attached at one end 33 to the lateral side of boot 10 by a second mounting member 20*b*. Although strap 22 is shown as being attached to the boot 10 at two attachment points, it should be understood that the invention is not so limited and can be employed with a strap of any construction, including straps including a plurality of attachment points on each side of the boot. In the embodiment shown, the strap portion 23 is attached by a screw and T-nut in the manner discussed above.

Figure 4:
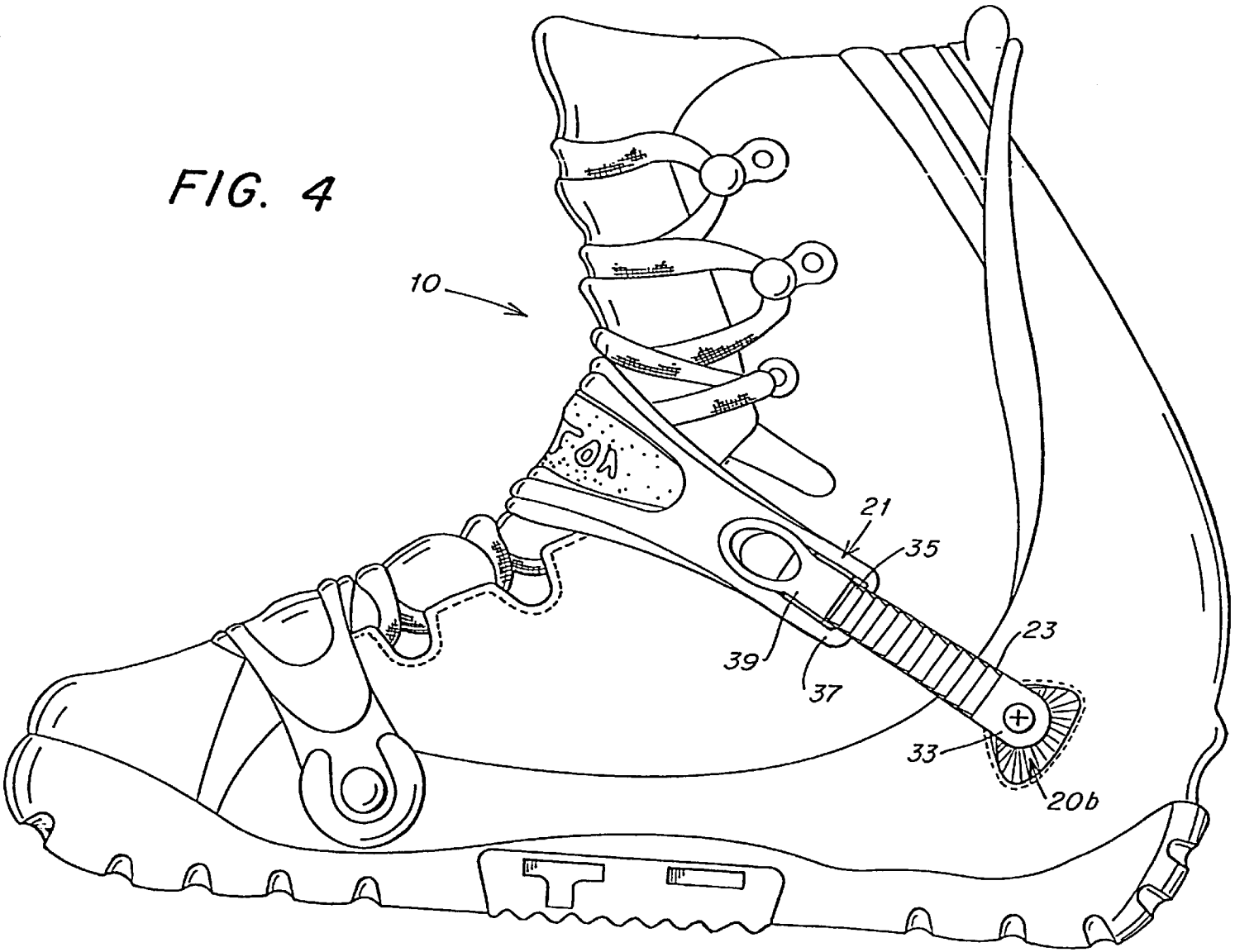
FIG. 4 is a lateral side view of the boot shown in FIG. 1, including a strap attached thereto.

The strap portion 23 is adjustably engageable, at a second end 35, in any of a plurality of positions with the strap portion 21 to selectively tighten and loosen strap 22 over the boot 10. In the embodiment shown, the second strap portion 23 is a ratcheting tongue that includes a plurality of teeth for engaging a ratchet buckle 39 attached to the second end 37 of the first strap portion 21, as shown in FIG. 4. However, the present invention is not limited in this respect, and can be employed with any type of adjustable strap.

Mounting members 20, 20*b* lift the first end 31 of first strap portion 21 and the first end 33 of the second strap portion 23, respectively, from engagement with the outer surface 18 of the boot 10 such that a space is created between the ends 31 and 33 of the strap 22 and the outer surface of the boot. These spaces reduce the pressure on the boot at either end when the strap 22 is tightened. For example, as shown in FIG. 4, second mounting member 20*b* lifts the first end 33 of the second strap portion 23 and creates a space between the first end 33 and the outer surface 18 of the boot. When the second strap portion 23 engages the second end 37 of the first strap portion 21 when strap 22 is tightened, the second end 37 slides under the second strap portion 23, which is passed through an opening in the buckle 39.

As discussed above, in a conventional ankle strap, the ratchet tongue is mounted directly to the outer surface of the boot. Thus, as the strap is tightened, the end of the conventional strap that corresponds to end 37 is wedged between the outer surface of the boot and the ratcheting strap, thereby creating pressure points on the rider's foot as the strap is tightened and the end 37 becomes more tightly wedged between the ratcheting strap and the boot. This wedging action also makes tightening the strap more difficult because of the friction created between the two strap components and between the strap end 37 and the outer surface of the boot.

Figure 5:
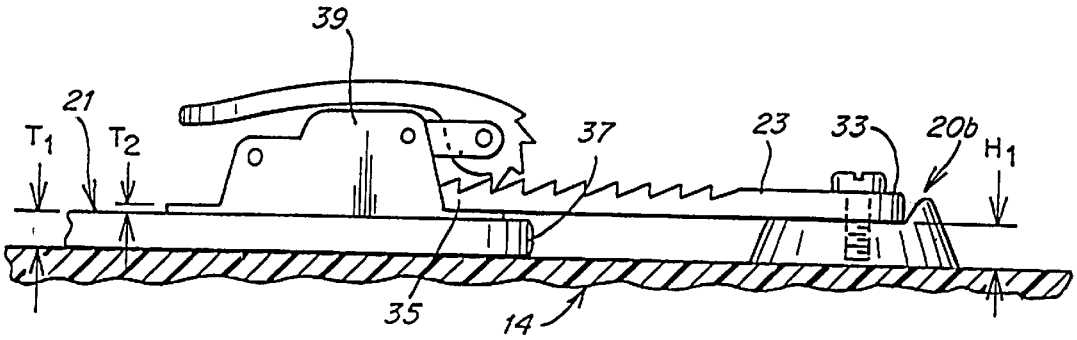
FIG. 5 is a cross-sectional view of the lateral side of the boot of FIG. 4.

In accordance with the embodiment of the present invention shown in FIG. 4, the space between the first end 33 of the second strap portion 23 and the outer surface 18 of the boot allows the strap portion 21 to fit more easily under the second strap portion 23, thereby reducing the downward pressure on the strap portion 21 (and consequently on the rider's foot) applied by the second strap portion 23 as the strap 22 is tightened. As shown in FIG. 5, the optimal height H1 for the mounting member 20 is dependent upon the thickness T1 of the strap portion 21 to which the ratchet buckle 39 is mounted, as well as the thickness T2 of the base of the ratchet buckle over which the second strap portion 23 passes when the strap 22 is tightened. It should be appreciated that the height H1 need not be greater than the combined thicknesses T1 and T2. In one embodiment of the invention, the height H1 is equal to 50% of the combined thicknesses T1 and T2. More preferably, the height H1 is within a range from 70%–130% of the combined thicknesses T1 and T2.

It should be appreciated that by raising the attachment of the ends of the strap 22 from the surface of the boot, a moment is generated at the engagement of the mounting member and the boot as the strap is tightened. Thus, to distribute the moment, in one embodiment of the invention, the mounting member 20 is provided with a relatively wide base 24, 26 (FIG. 1). In the embodiment shown, this is achieved by angling the sidewalls of the mounting member 20 (e.g., by 45 degrees or more).

Figure 6:
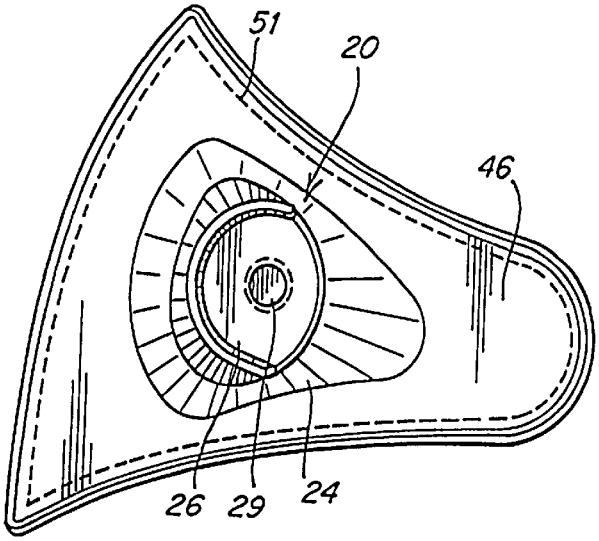
FIG. 6 is a top view of the raised mounting member of FIG. 1 in conjunction with a low-friction surface in accordance with one illustrative embodiment of the invention.

In another embodiment of the present invention shown in FIGS. 1–2, the portion of the boot 10 over which the strap portion 21 moves as the strap 22 is tightened is provided with a surface 46 that has a relatively lower coefficient of friction than the portions of the boot surrounding it. Typical materials used for the upper portion of a soft snowboard boot include leather, polyurethane coated leather, nylon, vinyl and synthetic leather. Thus, in one embodiment of the invention, the boot is provided with a low-friction surface that has a coefficient of friction lower than that for all of these materials. For example, the low-fiction surface 46 can be disposed on the lateral and/or medial side of the boot 10, adjacent engagement members 20*b* and 20, respectively. Low-friction surface 46 allows strap portion 23 to more readily slide over the outer surface 18 of the boot, making it easier to adjust the strap 22. In the embodiment of the invention shown in FIGS. 1–2, the low-friction surface 46 includes an aperture 48 for receiving the mounting member 20, and is fixed (i.e., non-removably attached) to the boot 10, e.g., by the stitching 50 about its perimeter. In another embodiment, shown in FIG. 6, the low-friction surface 46 and mounting member 20 are formed as a single, unitary member, and are attached the boot by stitching 51 about the perimeter of the unitary member. The low-friction surface can be made of plastic for example, Thermoplastic polyurethane (TPU), nylon, Hytrel™ available from DuPont, or other suitable materials. The material can be selected to be sufficiently flexible to conform to the contour of the boot, be resistant to extreme weather conditions, and to be not of such low friction that the rider can overload the strap by applying too much tension. By reducing, but not eliminating the friction, the rider can easily tighten the strap while still receiving feedback as the strap is tightened, thereby enabling the rider know when to stop tightening the strap so that too much pressure is not placed on the rider's foot.

Figure 3:
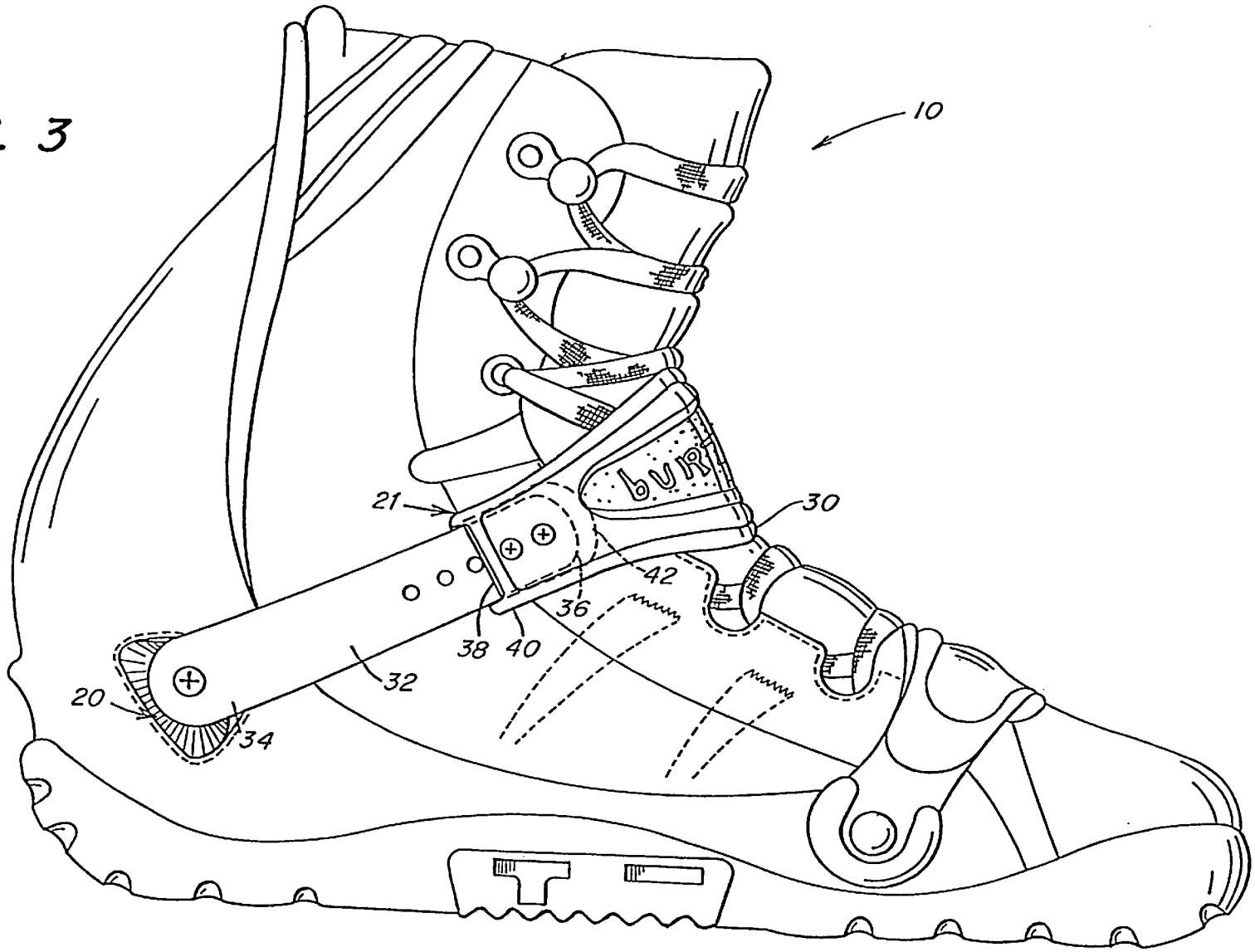
FIG. 3 is a medial side view of the boot shown in FIG 1, including a strap having an adjustable length attached thereto.

As discussed above, the present invention can be employed with boots and straps of any configuration. In one embodiment of the invention, the present invention is employed with an adjustable length strap as shown in FIG. 3. This strap is also described in commonly assigned U.S. patent application Ser. No. 08/886,917 filed Jul. 2, 1997.

As shown in FIG. 3, in accordance with this embodiment of the invention, the strap portion 21 includes a first strap piece 30 that is adapted to overlie and contact the snowboard boot 10, and a second strap piece 32 that is moveably mounted to the first strap piece 30, so that the length of the strap portion 21 can be selectively adjusted by the rider to fit differently sized boots. The second strap piece 32 includes a first end 34 that is removably attached to mounting member 20, as described above, and a second end 36 that is sized to be inserted through a slit 38 cut into a first end 40 of the first strap piece 30. The second end 36 of second strap piece 32 may be adjusted relative to the first end 40 of first strap piece 30, by moving a length of the second strap piece 32 into a pocket 42 formed within the first strap piece, to non-permanently change the overall length of first portion 21, and therefore strap 22.

The use of pocket 42 allows the length of the strap portion 21 to be changed in a non-permanent manner by holding any excess length of the second strap piece 32 within the pocket, so that it need not be cut by the rider to prevent the excess length from dragging during riding. By utilizing first and second strap pieces 30, 32 and pocket 42, the first portion 21 may be shortened and then lengthened by the rider, as desired, without cutting either strap piece.

Having thus described certain embodiments of the present invention, various alterations, modifications, and improvements will readily occur to those skilled in the art. Such alterations, modifications, and improvements are intended to be within the spirit and scope of the invention. Accordingly, the foregoing description is by way of example only, and not intended to be limiting. The invention is limited only as defined in the following claims and the equivalents thereof.

I claim:

1. A snowboard boot, comprising:

a boot upper having an outer surface;

a sole; and an adjustable strap that is mounted to the outer surface of the boot upper, the strap being adjustable so that the strap can be selectively tightened and loosened over the outer surface of the boot upper;

wherein the outer surface of the boot upper is formed from at least first and second materials, the first material having a lower coefficient of friction than the second material, the first material being disposed to underlie a portion of the strap that is movable to tighten the strap.

2. The snowboard boot of claim 1, wherein the first material has a lower coefficient of friction than any of leather, polyurethane-coated leather, nylon, vinyl and synthetic leather.

3. The snowboard boot of claim 1, wherein the strap is removably attached to the outer surface of the boot upper.

4. The snowboard boot of claim 1, wherein the strap includes a ratchet tongue and a ratchet buckle adapted to mate with the ratchet tongue.

5. The snowboard boot of claim 1, wherein the strap is an ankle strap adapted to hold a rider's heel down in the boot.

6. The snowboard boot of claim 1, wherein the boot is a soft snowboard boot.

7. The snowboard boot of claim 1, wherein the strap includes a first strap component and a second strap component that are adjustably engageable to selectively tighten and loosen the strap over the boot, wherein a first portion of the second strap component moves beneath the first strap component when the strap is tightened, and wherein the first material is disposed to underlie the second strap component.

8. A snowboard boot for use with an adjustable snowboard boot strap that is attachable thereto, the strap being adjustable so that the strap can be selectively tightened and loosened over the boot, the boot comprising:

a boot upper having an outer surface;

a sole; and a strap mounting member that is mounted to the outer surface of the boot upper and includes an attachment feature adapted to mount a portion of the strap to the snowboard boot;

wherein the outer surface of the boot upper is formed from at least first and second materials, the first material having a lower coefficient of friction than the second material, the first material being disposed adjacent the strap mounting member and being adapted to underlie a portion of the strap that is movable to tighten the strap.

9. The snowboard boot of claim 8, wherein the first material has a lower coefficient of friction than any of leather, polyurethane-coated leather, nylon, vinyl and synthetic leather.

10. The snowboard boot of claim 8, in combination with the snowboard boot strap.

11. The combination of claim 10, wherein the strap is an ankle strap adapted to hold a rider's heel down in the boot.

12. The combination of claim 10, wherein the strap includes a first strap component and a second strap component that are adjustably engageable to selectively tighten and loosen the strap over the boot, wherein a first portion of the second strap component moves beneath the first strap component when the strap is tightened, and wherein the first material is disposed to underlie the second strap component.

13. The snowboard boot of claim 8, further including a mating feature adapted to engage with a strapless binding.

14. The snowboard boot of claim 8, further including a mating feature adapted to engage with a step-in binding.

* * * * *